US005457081A

United States Patent [19]

Takiguchi et al.

[11] Patent Number: 5,457,081

[45] Date of Patent: Oct. 10, 1995

[54] THERMAL TRANSFER IMAGE RECEIVING SHEET

[75] Inventors: Ryohei Takiguchi; Hitoshi Saito; Masanori Torii; Hiroshi Yamada; Jun Hasegawa, all of Tokyo, Japan

[73] Assignee: Dai Nippon Printing Co., Ltd., Japan

[21] Appl. No.: 59,596

[22] Filed: May 12, 1993

[30] Foreign Application Priority Data

| | | | |
|---|---|---|---|
| May 15, 1992 | [JP] | Japan | 4-148082 |
| Sep. 9, 1992 | [JP] | Japan | 4-265523 |
| Sep. 25, 1992 | [JP] | Japan | 4-279246 |

[51] Int. Cl.[6] ..... B41M 5/035; B41M 5/38

[52] U.S. Cl. ..... 503/227; 428/195; 428/331; 428/447; 428/480; 428/913; 428/914

[58] Field of Search ..... 8/471; 428/195, 428/480, 913, 914, 331, 447; 503/227

[56] References Cited

U.S. PATENT DOCUMENTS

| | | | |
|---|---|---|---|
| 4,775,658 | 10/1988 | Matsuda et al. | 503/227 |
| 4,830,911 | 5/1989 | Kohima et al. | 428/342 |
| 4,992,414 | 2/1991 | Kishida et al. | 503/227 |
| 5,096,876 | 3/1992 | Jahn et al. | 503/227 |
| 5,169,468 | 12/1992 | Royce et al. | 156/234 |

FOREIGN PATENT DOCUMENTS

| | | | |
|---|---|---|---|
| 0405248 | 1/1991 | European Pat. Off. | 503/227 |
| 2605934 | 5/1988 | France | 503/227 |
| 61-3796 | 1/1986 | Japan | 503/227 |
| 61-27282 | 2/1986 | Japan | 503/227 |
| 63-82791 | 4/1988 | Japan | 503/227 |
| 2-276683 | 11/1990 | Japan | 503/227 |
| 2-274591 | 11/1990 | Japan | 503/227 |
| 2-277692 | 11/1990 | Japan | 503/227 |
| 3-7384 | 1/1991 | Japan | 503/227 |
| 9201564 | 2/1992 | WIPO | 503/227 |

*Primary Examiner*—B. Hamilton Hess
*Attorney, Agent, or Firm*—Parkhurst, Wendel & Rossi

[57] ABSTRACT

A thermal transfer image receiving sheet which can provide an image according to a thermal transfer printing process wherein use is made of a sublimable dye. The image has high density and sharpness and is excellent in various types of fastness, particularly fingerprint resistance, plasticizer resistance, etc. The thermal transfer image receiving sheet of the present invention includes a substrate sheet and a dye receiving layer formed on at least one surface of the substrate sheet, wherein the dye-receiving layer includes a dispersion of a dye-receiving resin dispersed in an aqueous medium.

27 Claims, No Drawings

THERMAL TRANSFER IMAGE RECEIVING SHEET

BACKGROUND OF THE INVENTION

The present invention relates to a thermal transfer image receiving sheet and more particularly to a thermal transfer image receiving sheet capable of forming a record image excellent in the color density, sharpness and various types of fastness, particularly durability such as fingerprint resistance and plasticizer resistance.

Various thermal transfer printing processes are known in the art. One of them is a transfer printing process which comprises supporting a sublimable dye as a recording agent on a substrate sheet, such as a polyester film, to form a thermal transfer sheet and forming various full color images on an image-receiving sheet dyeable with a sublimable dye, for example, an image-receiving sheet comprising paper, a plastic film or the like and, formed thereon, a dye-receiving layer.

In this case, a thermal head of a printer is used as heating means, and a number of color dots of three or four colors are transferred to the image-receiving material, thereby reproducing a full color image of an original by means of the multicolor dots.

Since the color material used is a dye, the image thus formed is very sharp and highly transparent, so that the resultant image is excellent in the reproducibility and gradation of intermediate colors. Therefore, according to this method, the quality of the image is the same as that of an image formed by the conventional offset printing and gravure printing, and it is possible to form an image having a high quality comparable to a full color photographic image.

Not only the construction of the thermal transfer sheet but also the construction of an image-receiving sheet for forming an image are important for usefully practicing the above-described thermal transfer process.

For example, Japanese Patent Laid-Open Publication Nos. 169370/1982, 207250/1982, 25793/1985, 64899/1985 and 82791/1988, etc. disclose prior art techniques applicable to the above-described thermal transfer image-receiving sheet, wherein the dye-receiving layer is formed by using vinyl resins such as a polyester resin, a polyvinyl chloride, a polycarbonate resin, a polyvinyl butyral resin, an acrylic resin, a cellulosic resin, an olefin resin and a polystyrene resin, or by using these resins in combination with a colloidal silica.

In the above-described thermal transfer image receiving sheet, the dye-receiving sheet is usually formed by dissolving the above-described resin in a high volatile organic solvent, for example, a general-purpose organic solvent, such as toluene, methyl ethyl ketone or ethyl acetate, to prepare a coating solution, coating the coating solution on the surface of a substrate sheet and drying the resultant coating. In this case, since the solvent is volatile, the resultant coating can be easily dried. Further, since the resin constituting the dye receiving layer, as such, is substantially lipophilic, the dyeability with a dye of the dye-receiving layer is so good that it is possible to form an image having high density and sharpness. The above-described thermal transfer image receiving sheet, however, has problems, such as fading of the formed image due to sweat or sebum migrated to the image surface when the hand touched the dye-receiving layer at its dye image portion formed by dyeing and swelling or cracking of the image-receiving layer per se, that is, a problem of fingerprint resistance, bleeding of the dye when the dye in contact with a substance containing a plasticizer, such as an eraser or a soft vinyl chloride resin, that is, a problem of plasticizer resistance, and a problem of the releasability of the thermal transfer sheet at the time of the formation of an image.

Accordingly, an object of the present invention is to provide a thermal transfer image receiving sheet which can provide an image having high density and sharpness and excellent in various types of fastness, particularly fingerprint resistance, plasticizer resistance, releasability, etc., according to a thermal transfer printing process wherein use is made of a sublimable dye.

DISCLOSURE OF THE INVENTION

The above-described object can be attained by the following present invention. Specifically, according to the present invention, there is provided a thermal transfer image receiving sheet comprising a substrate sheet and a dye-receiving layer formed on at least one surface of the substrate sheet, wherein said dye-receiving layer comprises a dispersion of a dye-receiving resin dispersed in an aqueous medium.

The formation of the dye-receiving layer by using a dispersion comprising an aqueous medium and, dispersed therein, a dye-receiving resin substantially insoluble in a general-purpose solvent can contribute to an improvement in the durability of the formed image, such as fingerprint resistance and plasticizer resistance.

According to one preferred embodiment of the present invention, the dye-receiving layer is formed by using the above-described aqueous resin dispersion, a water-dispersible or water-soluble silicone oil and/or a colloid solution of ultrafine particles of silicic anhydride (colloidal silica), which contributes to the releasability of the transfer sheet at the time of the formation of an image.

According to another preferred embodiment of the present invention, the dye-receiving resin comprises a polyester resin having a hydrophilicity imparted by introducing a minor amount of a sulfonic group or a group of a salt of sulfonic acid to the polyester resin to such an extent that the polyester resin can be easily dispersed in an aqueous medium, which can provide a thermal transfer image receiving sheet capable of forming an image having satisfactory density and sharpness and excellent in the durability of the formed image, such as fingerprint resistance and plasticizer resistance, etc., without use of any general-purpose solvent.

BEST MODE FOR CARRYING OUT THE INVENTION

The present invention will now be described in more detail with reference to the following preferred embodiments of the present invention.

The thermal transfer image-receiving sheet of the present invention comprises a substrate sheet and a dye-receiving layer formed on at least one surface of the substrate sheet.

There is no particular limitation on the substrate sheet used in the present invention, and examples of the substrate sheet useable in the present invention include synthetic paper (polyolefin, polystyrene and other synthetic paper), wood free paper, art paper, coat paper, cast coat paper, wall paper, paper for backing, paper impregnated with a synthetic resin or an emulsion, paper impregnated with a synthetic rubber latex, paper containing an internally added synthetic resin, fiber board, etc., cellulose fiber paper, and films or sheets of various plastics, such as polyolefin, polyvinyl chloride, polyethylene terephthalate, polystyrene, polymethacrylate and polycarbonate. Further, use may be made of a white opaque film or a foamed sheet prepared by adding a white pigment or filler to the above-described synthetic resin and forming a film from the mixture or foaming the mixture.

Further, use may be made of a laminate comprising any combination of the above-described substrate sheets. Typical examples of the laminate include a laminate comprising a combination of a cellulose fiber paper with a synthetic paper and a laminate comprising a combination of a cellulose fiber paper with a plastic film or sheet. The thickness of these substrate sheets may be arbitrary and is generally in the range of from about 10 to 300 μm.

When the substrate sheet is poor in the adhesion to a receiving layer formed on the surface thereof, it is preferred that the surface of the substrate sheet be subjected to a primer treatment or a corona discharge treatment.

The receiving layer formed on the surface of the substrate sheet serves to receive a sublimable dye moved from the thermal transfer sheet and to maintain the formed image.

In the present invention, the resin for forming the dye-receiving layer is preferably composed mainly of a polyester resin easily dispersible in an aqueous medium (optionally containing an organic solvent).

The polyester resin may be rendered easily dispersible in an aqueous medium, for example, by a method described in Japanese Patent Publication No. 58092/1986. However, the polyester resin used in the present invention is preferably insoluble or sparingly soluble in general-purpose organic solvents, such as methyl ethyl ketone, toluene, ethyl acetate, chloroform or ethanol. The polyester resin is preferably rendered insoluble or sparingly soluble in general-purpose organic solvents by properly selecting starting compounds in the synthesis of the polyester.

Examples of the acid moiety of the polyester resin used in the present invention include aromatic compounds, for example, terephthalic acid, isophthalic acid, o-phthalic acid and 2,6-naphthalenedicarboxylic acid, and aliphatic or alicyclic dicarboxylic acids, for example, succinic acid, adipic acid, azelaic acid, sebacic acid, dodecanedionic acid, dimer acid, tetrahydrophthalic acid, hexahydrophthalic acid, hexahydroisophthalic acid and hexahydroterephthalic acid.

Further, if necessary, p-hydroxybenzoic acid, p-(2hydroxyethoxy)benzoic acid, hydroxypivalic acid, γ-butyrolactone, ε-caprolactone, etc. may be used in combination with the above-described acid moiety. Further, if necessary, a trifunctional or higher functional polycarboxylic acid, such as trimellitic acid or pyromellitic acid, may be used in an amount of 10% by mole or less based on the whole carboxylic acid moiety.

In the present invention, an acid moiety comprising particularly the aromatic dicarboxylic acid among the above-described acid moieties, part of which is substituted with a sulfonic acid or a salt thereof, is preferably used in an amount of 0.5 to 10% by mole based on the whole acid moiety for the purpose of rendering the resultant polyester resin insoluble or sparingly soluble in general-purpose organic solvents and water-dispersible in water. The use of such an acid moiety in an amount of 1.0 to 6% by mole based on the whole acid moiety is still preferred. When the amount of use thereof is less than 0.5%, there is a possibility that the water dispersibility of the formed dye-receiving layer resin lowers. Preferred examples of the aromatic dicarboxylic acid partially substituted with a sulfonic acid (or a group of a salt thereof) include sulfoterephthalic acid, 5-sulfoisophthalic acid, 4-sulfophthalic acid, 4-sulfonaphthalene-2,7-dicarboxylic acid, 5(4sulfophenoxy)isophthalic acid and lithium, potassium, magnesium, calcium, copper, iron and other salts of the above-described aromatic dicarboxylic acids. Among them, 5-sodium sulfoisophthalate is particularly preferred.

Examples of polyol moiety as another starting compound include ethylene glycol, 1,2-propylene glycol, 1,3-propane diol, 1,4-butanediol, neopentyl glycol, 1,5pentanediol, 1,6-hexanediol, 1,4-cyclohexanedimethanol and tricyclodecanedimethanol (TCD-M). In order to improve the light fastness of an image formed in the dye-receiving layer, it is preferred to use TCD-M as the whole or part of the diol component.

Further, if necessary, a trifunctional or higher functional polyol, such as trimethylolpropane, trimethylolethane, glycerin or pentaerythritol, may be used in an amount of 5% by weight or less based on the whole polyol moiety in combination with the above-described polyol moiety. In particular, use may be made of a polyethylene glycol having a molecular weight of 106 to 10,000 in an amount of 5% by weight or less based on the whole polyol moiety.

The polyester comprising the above-described moieties may be produced by any conventional method, and there is no particular limitation on the production method. The glass transition temperature of the polyester can be regulated by using terephthalic acid or isophthalic acid. In the present invention, the glass transition temperature is preferably 50° to 120° C., and a molecular weight in the range of from 5,000 to 40,000 is optimal.

In the present invention, in order to render the polyester resin insoluble or sparingly insoluble in general-purpose organic solvents and water-dispersible, it is preferred to use ethylene glycol in an amount of 75% by mole or more based on the whole polyol moiety. A water dispersion of the above-described polyester can provide an image-receiving paper having excellent fingerprint resistance and plasticizer resistance. In order to provide an image-receiving paper excellent in not only the fingerprint resistance and plasticizer resistance but also light fastness, it is still preferred that use be made of such a formulation that ethylene glycol occupies 75 to 90% by mole of the whole diol moiety. In the present invention, the expression "insoluble or sparingly soluble" is intended to mean that the solubility of the polyester resin in methyl ethyl ketone, toluene, ethyl acetate, chloroform or ethanol at 25° C. is 5% by weight or less. The plasticizer resistance, fingerprint resistance and other properties of a dye image formed on the dye-receiving layer can be improved by rendering the polyester resin insoluble in general-purpose solvents.

The above-described embodiments are preferred methods for rendering the polyester resin used in the present invention insoluble or sparingly soluble in general-purpose organic solvents. It is also possible to render the polyester resin hydrophilic by introducing a polyethylene oxide group or carboxyl group into the polyester resin.

Further, in the present invention, in order to render the polyester resin water-dispersible, it is possible to use a polymer comprising an aromatic unit having a good symmetry.

The above-described polyester resin can be dispersed in an aqueous medium by previously stirring the polyester resin in a solvent, such as methanol, ethanol, propanol, butanol, ethylene glycol, propylene glycol, methyl cellosolve, ethyl cellosolve, butyl cellosolve, 3-methyl3-methoxybutanol, n-butyl cellosolve acetate, dioxane, ethyl acetate, methyl ethyl ketone, cyclohexanone, cyclooctanone, cyclodecanone or isophorone, particularly preferably butyl cellosolve, ethyl cellosolve, isopropanol or other solvent, with heating to prepare a viscous melt, and then adding the melt to water with stirring at a temperature of 40° to 200° C. Alternatively, water may be added to the above-described organic solvent solution with vigorous stirring.

Further, in the formation of the dye-receiving layer, when the above-described polyester resin dispersion is used in the form of a mixture thereof with an aqueous dispersion of a polyester resin of the same type as described above but having a glass transition temperature lowered to 50° C. or below or an aqueous dispersion of a resin having a glass transition temperature below the above-described polyester resin, i.e., −20° C. or above, preferably −10° to 90° C., such as polyvinyl acetate, vinyl acetate/acryl polymer, an ester of polyacrylic acid, an ester of self-crosslinking polyacrylic acid, styrene/acryl copolymer, polystyrene, ethylene/vinyl acetate copolymer, ethylene/vinyl acetate/acryl terpolymer or polyvinyl chloride, the dyeability with a dye and the image density can be improved without a lowering in the fingerprint resistance and plasticizer resistance.

In order to stabilize dispersed particles of these aqueous dispersions, it is possible to use anionic or nonionic surfactants, polyvinyl alcohol, gelatin, modified polyvinyl alcohol for protective colloids, starch, cellulose compounds, etc. Further, low-molecular weight or high-molecular weight plasticizers may be incorporated in the aqueous dispersion for the purpose of regulating the glass transition temperature.

Although the proportions of use of the aqueous dispersion of the above-described resin and the aqueous dispersion of the resin having a lower glass transition temperature are not particularly limited, the ration of the former aqueous dispersion to the latter aqueous dispersion on a solid basis, for example, is in the range of from 0.1 to 10, preferably in the range of from 1 to 5.

Further, in order to improve the light fastness of the formed image, it is preferred to previously incorporate photostabilizers including ultraviolet absorbers, such as benzotriazole and benzophenone, and antioxidants, such as hindered amine and hindered phenol, into the above-described resin for forming the dye-receiving layer, or to mix an aqueous dispersion with the above-described resin dispersion.

In order to improve the peelability of the thermal transfer sheet at the time of the formation of an image, the above-described aqueous dispersion of resin may be used in combination with a commercially available water-dispersible or water-soluble modified silicone oil and/or a colloid solution of ultrafine particles of silicic anhydride (colloidal silica) in a suitable proportion.

The particle diameter of ultrafine particles of silicic anhydride in the colloid solution (colloidal silica) is preferably 100 nm or less. The use of colloidal silica having a particle diameter of 20 nm or less is particularly preferred. The shape of the silica sol is not limited to a sphere, and use may be made of a colloid solution of deformed silica sol in the form of a rod having a thickness of 5 to 20 nm and a length of 40 to 300 nm.

In the present invention, the above-described polyester resin may be used in combination with resins used in the formation of conventional dye-receiving layers, for example, polyolefin resins such as polypropylene, halogenated polymers, such as polyvinyl chloride and polyvinylidene chloride, vinyl polymers, such as polyvinyl acetate, polyacrylic esters and polyvinyl acetal, polyester resins, such as polyethylene terephthalate and polybutylene terephthalate, polystyrene resins, polyamide resins, copolymer resins comprising olefins, such as ethylene or propylene, and other vinyl monomers, ionomers, cellulosic resins, such as cellulose diacetate, and polycarbonates, in such an amount as will not inhibit the attainment of the object of the present invention.

The thermal transfer image receiving sheet of the present invention can be formed by coating at least one surface of the above-described substrate sheet with a coating solution of the above-described aqueous dispersion prepared by the above-described method and comprising, as a main component, the above-described polyester resin (or a mixture of this aqueous dispersion with an aqueous dispersion of other resin) and, optionally added thereto, other necessary additives, for example, a release agent, an inorganic filler of ultrafine particles, a crosslinking agent, a curing agent, a catalyst and a heat release agent, for example, by a gravure printing method, a screen printing method or a reverse roll coating method wherein use is made of a gravure print, and drying the resultant coating to form a dye-receiving layer.

In the polyester used in a preferred embodiment of the present invention, the terminal of the main chain of the polymer may be a hydroxyl group or a carboxyl group. It is also possible for a reactive functional group of these terminals or a reactive group located on the side chain to be reacted with an epoxy resin, a polyisocyanate, a chelating agent, such as aluminum, zinc, titanium or zirconium, a crosslinking agent having an aziridine group or an oxazoline group, or a crosslinking agent, such as melamine, to effect curing for the purpose of improving the coating strength of the dye-receiving layer so far as the object of the present invention is not spoiled. When use is made of a crosslinking agent, it is also possible to use a known catalyst in the reaction system. When the reactive functional group in the polymer chain is a hydroxyl group, it is possible to use, for example, Orgatix TC-300, Orgatix TC-310, Orgatix ZB-110 and Orgatix A1-135, which are chelating agents manufactured by Matsumoto Trading Co., Ltd. In this case, the coating strength of the dye-receiving layer can be improved. When the reactive functional group in the polymer chain is a carboxyl group, it is possible to use, for example, Chemitite PZ-33 and Chemitite DZ-22E, which are aziridine crosslinking agents manufactured by Nippon Shokubai Co., Ltd., Epocros K-1010E, Epocros K-1020E, Epocros K-1030E, Epocros CX-K2010E, Epocros CX-K2020E and Epocros CX-K2030E, which are water dispersions of oxazoline crosslinking agents manufactured by Nippon Shokubai Co., Ltd., CX-WS-140 which is an oxazoline-group-containing polymer crosslinking agent (water soluble) manufactured by Nippon Shokubai Co., Ltd., etc. In this case as well, the coating strength of the dye-receiving layer can be improved.

Water-soluble crosslinking agents are particularly preferred as the crosslinking agent.

According to a further preferred embodiment of the present invention, the above-described polyester resin is used in combination with particular resins. This embodiment will now be described.

In the present invention, preferred examples of the resin used in combination with the above-described polyester resin include solvent-soluble polyester resins and polycarbonate resins. When the above-described polyester resin is used in combination with the polycarbonate resin, it is preferred for the polycarbonate resin to have structural units represented by the following general formulae (1) and (2):

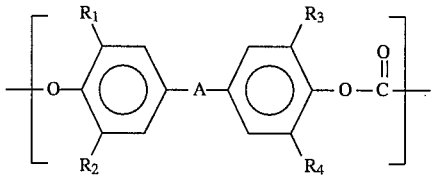

(1)

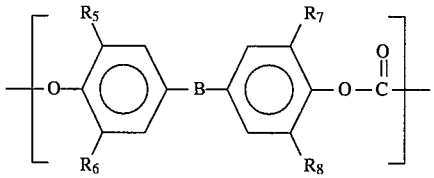

(2)

wherein $R_1$ to $R_8$ stand for hydrogen, a halogen or an alkyl group having 1 to 4 carbon atoms, A stands for a straight-chain, branched or cyclic alkylidene group having 1 to 10 carbon atoms, an aryl-substituted alkylidene group, an aryl group or a sulfonyl group and B stands for an oxygen atom or a sulfur atom.

The above-described polycarbonate resin is still preferably a random copolycarbonate resin wherein the molar ratio of the structural unit represented by the general formula (1) to the structural unit represented by the general formula (2) is in the range of from 30:70 to 70:30. The molecular weight of these polycarbonate resins is preferably in the range of from 5,000 to 50,000.

The weight ratio of the polyester resin (A) insoluble or sparingly soluble in a solvent to the other resin (B), i.e., the (A) to (B) weight ratio, is preferably in the range of from 60:40 to 95:5. When the amount of the resin (B) is excessively large, the fingerprint resistance or plasticizer resistance lowers although the image density can be improved. On the other hand, when the amount of the resin (B) is excessively small, the results are reversed.

Further, in order to stabilize dispersed particles of the aqueous dispersions of resins, it is possible to use anionic or nonionic surfactants, polyvinyl alcohol, gelatin, modified polyvinyl alcohol for protective colloids, starch, cellulose compounds, etc. Further, low-molecular weight or high-molecular weight plasticizers may be incorporated in the aqueous dispersion for the purpose of regulating the glass transition temperature.

The resin can be dispersed by any of a method which comprises previously mixing two or more resins with each other (for example, by melt mixing) and dispersing the mixture in an aqueous medium, a method which comprises dissolving two or more resins in a common solvent and subjecting the solution to precipitation and dispersion in water, and a method which comprises dispersing resins in respective aqueous media and mixing the resultant dispersions with each other. Among them, the method which comprises dissolving two or more resins in a common solvent and subjecting the solution to precipitation and dispersion in water is preferred. According to this method, even polycarbonate resins etc. which have hitherto had difficulty in dispersion in an aqueous medium can be successfully dispersed together with the polyester resin in an aqueous medium.

The composition of the dispersion is preferably such that (A) the polyester resin insoluble or sparingly soluble in a solvent, (B) the resin other than the polyester resin (A), (C) the water-soluble organic solvent having a boiling point of 60° to 200° C. and (D) water satisfy requirements represented by the following respective equations 1 to 3:

$$A+B+C+D=100(\text{weight ratio}) \qquad \text{equation 1}$$

$$A:B:C:D=10 \text{ to } 70:2 \text{ to } 40:1 \text{ to } 10:20 \text{ to } 87 \text{ (weight ratio)} \qquad \text{equation 2}$$

$$.02 \leqq C/(C+D) \leqq .66 \qquad \text{equation 3}$$

In order to improve the light fastness of the formed image, it is preferred to previously incorporate photostabilizers including ultraviolet absorbers, such as benzotriazole and benzophenone ultraviolet absorbers, and antioxidants, such as hindered amine and hindered phenol, into the above-described resin for forming the dye-receiving layer, or to mix and dissolve water-soluble ultraviolet absorbers etc. in the above-described aqueous dispersion. Among the above-described photostabilizers, examples of water-soluble photostabilizers include those represented by the following structural formulae:

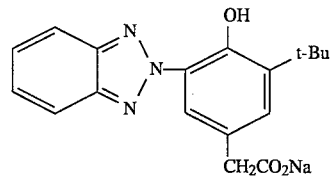

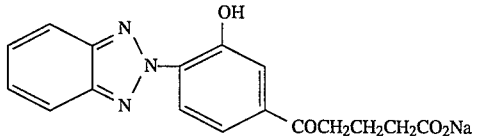

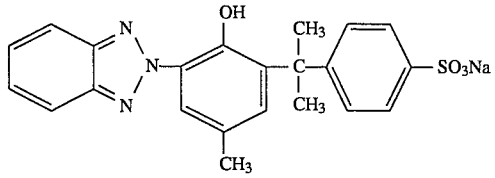

The thermal transfer image receiving sheet of the present invention can be produced by coating at least one surface of the above-described substrate sheet with a coating solution of the above-described aqueous dispersion prepared by the above-described method and comprising, as a main component, the above-described polyester resin and, optionally added thereto, other necessary additives, for example, a release agent, an inorganic filler of ultrafine particles, a crosslinking agent, a curing agent, a catalyst and a heat release agent, for example, by a gravure printing method, a screen printing method or a reverse roll coating method wherein use is made of a gravure print, and drying the resultant coating to form a dye-receiving layer.

In order to improve the coating strength of the dye-receiving layer, it is possible to incorporate an epoxy resin, a polyisocyanate, a chelating agent, such as aluminum, zinc, titanium or zirconium, in such an amount as will not spoil the object of the present invention.

In the formation of the above-described dye-receiving layer, pigments or fillers, such as titanium oxide, zinc oxide, kaolin clay, calcium carbonate and finely divided silica, may be added for the purpose of improving the whiteness of the dye-receiving layer to further enhance the sharpness of the transferred image.

Although the thickness of the dye-receiving layer thus formed may be arbitrary, it is generally in the range of from 1 to 50 μm. The above-described dye-receiving layer may be in the form of either a continuous coating formed by coating the dispersion and then heating the resultant coating to a relatively high temperature, or a discontinuous coating formed by drying the above-described coating at a low temperature.

A release layer may be formed with any release agent on the surface of the dye-receiving layer formed by the above-described method for the purpose of improving the peelability of the thermal transfer sheet from the dye layer at the time of printing. The release layer preferably comprises a reactive silicone, such as a hydroxy-, amino-, carboxy- or mercapto-modified reactive silicone. If necessary, the reactive silicone may be crosslinked with a polyol, a polyisocyanate, an aziridine crosslinking agent, an oxazoline crosslinking agent, melamine or the like. When the reactive silicone is crosslinked with a crosslinking agent, use may be made of a known catalyst suitable for use in the reaction system. The releasing efect can also be obtained by adding a release agent into the dye-receiving layer instead of forming the release layer. For example, in a water dispersion of polyester used in a preferred embodiment of the present invention, X51-789, which is a carboxy-modified polydimethylsiloxane manufactured by The Shin-Etsu Chemical Co., Ltd., may be used as the release agent thereby to give the dye-receiving layer per se good releasability. In this case, when the release agent is cured according to need, it is possible to use, as a crosslinking agent for a reaction with the carboxyl group, for example, Orgatix TC-300, Orgatix TC-310, Orgatix ZB-110 and Orgatix A1-135, which are chelating agents manufactured by Matsumoto Trading Co., Ltd., Chemitite PZ-33 and Chemitite DZ-22E, which are aziridine crosslinking agents manufactured by Nippon Shokubai Co., Ltd., Epocros K-1010E, Epocros K-1020E, Epocros K-1030E, Epocros CX-K2010E, Epocros CX-K2020E and Epocros CX-K2030E, which are water dispersions of oxazoline crosslinking agents manufactured by Nippon Shokubai Co., Ltd., and CX-WS140, which is an oxazoline-group-containing polymer crosslinking agent (water soluble) manufactured by Nippon Shokubai Co., Ltd. When the release agent is cured with the crosslinking agent, the releasability from the thermal transfer sheet can be improved as compared with that in the case where the release agent is not cured. When the polymer as a main component of the dye-receiving layer is reactive with the crosslinking agent for the release agent, the crosslinking agent gives rise to a crosslinking reaction with both the release agent and the dye-receptive resin. In this case, the release agent is more firmly fixed to the dye-receiving layer as compared with the case where the dye-receiving resin is not involved in the crosslinking.

Preferred examples of the above-described aziridine compound include 2,2'-bishydroxymethylbutanol-tris[3-(1-aziridinyl)propionate]and diphenylmethan-bis-4,4'-N,N'-diethylenurea.

The image-receiving sheet of the present invention can be applied to various applications where thermal transfer recording can be conducted, such as image-receiving sheets in a flat sheet or roll form, cards and sheets for preparing transparent originals, by properly selecting the substrate sheet.

Further, in the image-receiving sheet of the present invention, a cushion layer may be optionally provided between the substrate sheet and the receiving layer, and the provision of the cushion layer enables an image less susceptible to noise during printing and corresponding to image information to be formed by transfer recording with a good reproducibility.

The thermal transfer sheet for use in the case where thermal transfer is conducted through the use of the above-described thermal transfer sheet of the present invention comprises a paper or a polyester film and, provided thereon, a dye layer containing a sublimable dye, and any conventional thermal transfer sheet, as such, may be used in the present invention.

Means for applying a thermal energy at the time of the thermal transfer may be any means known in the art. For example, a desired object can be sufficiently attained by applying a thermal energy of about 5 to 100 mJ/mm$^2$ through the control of a recording time by means of a recording device, for example, a thermal printer (for example, a video printer VY-100 manufactured by Hitachi, Limited).

The present invention will now be described in more detail with reference to the following Examples and Comparative Examples. In the Examples and Comparative Examples, "parts" or "%" is by weight unless otherwise specified.

REFERENCE EXAMPLE A1

An autoclave equipped with a thermometer and an agitator was charged with 48 moles of dimethyl terephthalic acid, 4 moles of dimethyl sodiumsulfoisophthalate, 48 moles of dimethylisophthalic acid, 20 moles of TCD-M and 80 moles of ethylene glycol and 0.5 mole of tetrabutyl titanate. The reaction system was heated at 150° to 220° C. for 3 hr to effect transesterification and then heated to 250° C. over a period of 30 min, and the pressure of the system was gradually reduced so that it became 0.3 mmHg or less 45 min after the initiation of the reduction in the pressure. The reaction was continued for additional 90 min under this condition to provide a transparent polyester resin 1 of pale yellow (molecular weight: 18,000).

The same procedure was repeated to provide polyester resins listed in the following Table A1. Further, these polyester resins were dissolved in butyl cellosolve, the resultant solutions were added by portions to water to provide dispersions of polyester resins, and the solid content of the dispersions was regulated to 30%.

TABLE A1

| No. | Components | Number of moles |
|---|---|---|
| 1 | TCD-M | 20 |
| | ethylene glycol | 80 |
| | terephthalic acid | 48 |
| | isophthalic acid | 48 |
| | 5-sodium sulfoisophthalate | 4 |
| 2 | diethylene glycol | 20 |
| | ethylene glycol | 80 |
| | terephthalic acid | 48 |
| | isophthalic acid | 48 |
| | 5-sodium sulfoisophthalate | 4 |
| 3 | cyclohexanedimethanol | 10 |
| | ethylene glycol | 90 |
| | terephthalic acid | 48 |
| | isophthalic acid | 48 |
| | 5-sodium sulfoisophthalate | 4 |
| 4 | TCD-M | 20 |
| | ethylene glycol | 80 |
| | terephthalic acid | 90 |
| | isophthalic acid | 10 |
| 5 | diethylene glycol | 50 |
| | ethylene glycol | 50 |

TABLE A1-continued

| No. | Components | Number of moles |
|---|---|---|
| | terephthalic acid | 48 |
| | isophthalic acid | 48 |
| | 5-sodium sulfoisophthalate | 4 |
| 6 | TCD-M | 50 |
| | ethylene glycol | 50 |
| | terephthalic acid | 90 |
| | isophthalic acid | 10 |
| 7 | TCD-M | 20 |
| | ethylene glycol | 75 |
| | terephthalic acid | 50 |
| | isophthalic acid | 50 |
| 8 | ethylene glycol | 100 |
| | terephthalic acid | 50 |
| | isophthalic acid | 50 |
| Comp. Ex. | neopentyl glycol | 50 |
| | ethylene glycol | 50 |
| | terephthalic acid | 47 |
| | isophthalic acid | 42 |
| | sebacic acid | 11 |

In the following Examples, various properties of the thermal transfer image receiving sheet were evaluated based on the following criteria.

Production of Thermal Transfer Sheets Used in Evaluation

An ink composition for forming a dye-supporting layer was prepared according to the following formulation, coated by means of a wire bar on a 6 μm-thick polyethylene terephthalate film having a reverse face subjected to a treatment for rendering the face heat-resistant so that the coverage on a dry basis was 1.0 g/m$^2$, and the resultant coating was dried to provide a thermal transfer sheet.

| Ink composition | |
|---|---|
| Dye represented by the following structural formula | 1.0 part |
| Polyvinyl butyral resin | 10.0 parts |
| Methyl ethyl ketone/toluene (weight ratio = 1:1) | 90.0 parts |

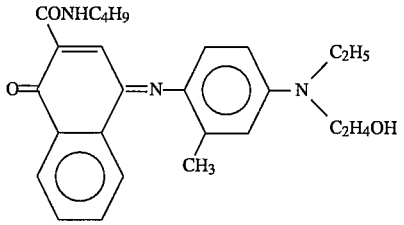

Evaluation Methods

The above-described thermal transfer sheet and thermal transfer image receiving sheets prepared in the following Examples and Comparative Examples were put on top of the other in such a manner that the dye layer and the dye receiving surface faced each other. Recording was conducted by means of a thermal head from the back surface of the thermal transfer sheet under conditions of a head applied voltage of 12.0 V, a pulse width of 16 msec and a dot density of 6 dots/line. Various properties were evaluated by the following methods.

(1) Printing Sensitivity (O.D.):

The reflection density of each image was measured with Macbeth densitometer RD-914, and the printing sensitivity was expressed in terms of the relative value by supposing the reflection density of the image formed in Comparative Example 1 to be 1.00.

(2) Light Fastness Test:

The print was subjected to irradiation by means of a xenon fadeometer (Ci-35A manufactured by Atlas) at 100 KJ/m$^2$ (420 nm), the change in the optical density between before irradiation and after irradiation was measured by means of an optical densitometer (RD-918 manufactured by Mcbeth), and the retention of the optical density was determined according to the following equation.

Retention (%)={[optical density after irradiation]/[optical density before irradiation]}×100

○:Retention was 85% or more.

Δ: Retention was 80 to 85% exclusive.

x: Retention was less than 80%.

(3) Evaluation of Fingerprint Resistance:

A finger was pressed against the surface of the print to leave a fingerprint, and the print was allowed to stand at room temperature for 5 days. Then, the discoloration and change in the density of the fingerprinted portion was evaluated with the naked eye.

A: Substantially no difference was observed between the fingerprinted portion and the non-fingerprinted portion.

B: A discoloration or a change in the density was observed.

C: Dropout occurred in the fingerprinted portion to such an extent that the shape of the fingerprint was clearly observed.

D: Dropout centered on the fingerprinted portion occurred and, at the same time, agglomeration of the dye was observed.

(4) Evaluation of Plasticizer Resistance:

An identical portion of the surface of the print was lightly rubbed with a commercially available eraser five times, and the change in the density was evaluated with the naked eye.

○: Substantially no change in the density was observed.

Δ: Change in the density was observed.

x: The density was greatly changed, and dropout occurred from the low density portion to the medium density portion.

(5) Evaluation of Releasability:

The above-described thermal transfer image receiving sheet was subjected to continuous black solid printing by means of a thermal printer (VY-P1 manufactured by Hitachi, Limited), and evaluation was effected on the occurrence of abnormal transfer with the naked eye.

○: Black solid printing could be successfully effected five times or more in a continuous manner.

Δ: Black solid printing could be successfully effected one to four times.

x: Black solid printing could not be successfully effected at all.

A thermal transfer image receiving sheet of Comparative Example was produced as follows.

Synthetic paper (thickness: 110 μm; a product of Oji-Yuka Synthetic Paper Co., Ltd.) was used as the substrate sheet, and a coating solution having the following composition was coated and dried by means of a wire bar on one surface of the synthetic paper so that the coverage on a dry basis was 5.0 g/m$^2$, and the resultant coating was dried to a comparative thermal transfer image receiving sheet which was then evaluated based on the above-described criteria. The results are also given in the following Table A2.

| Composition of Coating Solution: | |
|---|---|
| Polyester resin of Comparative Example listed in Table 1 | 10.0 parts |
| Catalytic curing silicone oil (X-62-1212 manufactured by The Shin-Etsu Chemical Co., Ltd.) | 1.0 part |
| Platinum catalyst (PL-50T manufactured by The Shin-Etsu Chemical Co., Ltd.) | 0.1 part |
| Methyl ethyl ketone/toluene (weight ratio = 1:1) | 89.0 parts |

EXAMPLES A1 to A6

Synthetic paper (thickness: 110 μm; a product of Oji-Yuka Synthetic Paper Co., Ltd.) was used as the substrate sheet, and a dispersion (solid content: 30%) of each polyester resin listed in Table A1 was coated and dried by means of a wire bar on one surface of the synthetic paper so that the coverage on a dry basis was 5.0 g/m$^2$, and the resultant coating was dried to provide thermal transfer image receiving sheets of Examples A1 to A6 which were then evaluated based on the abovedescribed criteria. The results are given in the following Table A2-1.

TABLE A2-1

| | Polyester | Overall evaluation | Relative sensitivity | Light fastness | Fingerprint resistance | Plasticizer resistance |
|---|---|---|---|---|---|---|
| Ex. A1 | 1 | ⊙ | 0.90 | ○ | A | ○ |
| Ex. A2 | 2 | ○ | 0.88 | Δ | A | ○ |
| Ex. A3 | 3 | ⊙ | 0.85 | ○ | A | ○ |
| Ex. A4 | 4 | ⊙ | 0.73 | ○ | A | ○ |
| Ex. A5 | 5 | Δ | 1.05 | ○ | B | Δ |
| Ex. A6 | 6 | Δ | 0.89 | ○ | B | Δ |
| Ex. A'1 | 7 | ⊙ | 0.90 | ○ | A | ○ |
| Ex. A'2 | 8 | ○ | 0.85 | Δ | A | ○ |
| Comp. Ex. | — | Δ | 0.87 | ○ | C | X |

EXAMPLES A7 to A12

Synthetic paper (thickness: 110 μm; a product of Oji-Yuka Synthetic Paper Co., Ltd.) was used as the substrate sheet, and a coating solution having the following composition was coated by means of a wire bar on one surface of the synthetic paper so that the coverage on a dry basis was 5.0 g/m$^2$, and the resultant coating was dried to provide thermal transfer image receiving sheets of Examples A7 to A12 which were then evaluated based on the above-described criteria. The results are given in the following Table A2-2.

| Composition of Coating Solution: | |
|---|---|
| Polyester resin (solid content: 30%) listed in Table A1 | 100 parts |
| Water-dispersible silicone (X-52-550B (solid content: 40%) manufactured by The Shin-Etsu Chemical Co., Ltd.) | 7.5 parts |

EXAMPLE A13

The production of a thermal transfer image receiving sheet, the formation of an image and the evaluation of the image were effected in the same manner as that of Example A1, except that the following coating solution was used instead of the coating solution used in Example A7. The results are given in the following Table A2-2.

| Composition of Coating Solution: | |
|---|---|
| Polyester resin 2 (solid content: 30%) listed in Table A1 and containing 5% of ultraviolet absorber (LA-31 manufactured by Asahi Denka Kogyo Ltd.) | 100 parts |
| Water-dispersible silicone (X-52-550B (solid content: 40%) manufactured by The Shin-Etsu Chemical Co., Ltd.) | 7.5 parts |

EXAMPLES A14 to A16

The production of thermal transfer image receiving sheets, the formation of images and the evaluation of the images were effected in the same manner as that of Example A7, except that the following coating solution was used instead of the coating solution used in Example A7. The results are given in the following Table A2-3.

| Composition of Coating Solution: | |
|---|---|
| Dispersion (solid content: 30%) of polyester resin 5 listed in Table A1 | 100 parts |
| Water dispersion of carboxy-modified silicone (X51-789 (solid content: 15%) manufactured by The Shin-Etsu Chemical Co., Ltd.) | 10 parts |
| Crosslinking agent listed in the following Table A2-2 | Amount of addition specified in the table |

TABLE A2-2

| | Crosslinking Agent | Amount of use (parts) |
|---|---|---|
| Ex. 14 | oxazoline crosslinking agent (CX-WS-140, main component content: 32%, product of Nippon Shokubai Co., Ltd.) | 7.5 |
| Ex. 15 | aziridine crosslinking agent (Chemitite PZ-33, main component content: 100%, product of Nippon Shokubai Co., Ltd. ) | 3.0 |
| Ex. 16 | chelator crosslinking agent (Orgatix TC-300, main component content: 50%, product of Matsumoto Trading Co., Ltd.) | 6.0 |

TABLE A2-3

| | Polyester | Overall evaluation | Relative sensitivity | Light fastness | Fingerprint resistance | Plasticizer resistance | Releasability |
|---|---|---|---|---|---|---|---|
| Ex. A7 | 1 | ◎ | 0.90 | ○ | A | ○ | Δ |
| Ex. A8 | 2 | ○ | 0.88 | Δ | A | ○ | Δ |
| Ex. A9 | 3 | ◎ | 0.85 | ○ | A | ○ | Δ |
| Ex. A10 | 4 | ◎ | 0.73 | ○ | A | ○ | Δ |
| Ex. A11 | 5 | Δ | 1.05 | ○ | B | Δ | Δ |
| Ex. A12 | 6 | Δ | 0.89 | ○ | B | Δ | Δ |
| Ex. A'3 | 7 | ◎ | 0.90 | ○ | A | ○ | Δ |
| Ex. A'4 | 8 | ○ | 0.85 | Δ | A | ○ | Δ |
| Ex. A13 | 2 | ◎ | 0.85 | ○ | A | ○ | Δ |
| Ex. A14 | 5 | ◎ | 1.01 | ○ | A | ○ | ○ |
| Ex. A15 | 5 | ○ | 0.98 | Δ | A | ○ | ○ |
| Ex. A16 | 5 | ○ | 0.95 | ○ | B | ○ | ○ |
| Comp. Ex. | — | Δ | 0.87 | Δ | C | X | Δ |

EXAMPLES A17 to A22

A water dispersion (solid content: 30%) (no water-dispersible silicone added) of a polyester resin listed in Table A1 was coated on synthetic paper in the same manner as that of Examples A1 to A6 to form a dye-receiving layer, and the following coating solution for a release layer was coated on the dye-receiving layer by means of a wire bar so that the coverage on a dry basis was 0.2 g/m$^2$, and the resultant coating was dried to provide thermal transfer image receiving sheets of Examples A17 to A22 which were then evaluated based on the above-described criteria. The results are given in the following Table A3. Similarly, a release layer was formed on the thermal transfer image receiving sheet of Comparative Example and evaluated, and the results are also given in the following Table A3.

| Coating Solution for Release Layer: | |
|---|---|
| Carbinol-modified silicone (X-22-160AS manufactured by The Shin-Etsu Chemical Co., Ltd.) | 10 parts |
| Xylylene diisocyanate modified with biuret (XA-14 (solid content: 40%) manufactured by Takeda Chemical Industries, Ltd.) | 125 parts |
| Diol represented by the following formula | 50 parts |
| Methyl ethyl ketone | 2125 parts |
| Dibutyltin dilaurate (isocyanate curing catalyst) | 0.1 part |

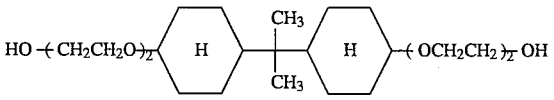

TABLE A3

| | Polyester | Overall evaluation | Relative sensitivity | Light fastness | Fingerprint resistance | Plasticizer resistance |
|---|---|---|---|---|---|---|
| Ex. A17 | 1 | ◎ | 0.90 | ○ | A | ○ |
| Ex. A18 | 2 | ○ | 0.88 | Δ | A | ○ |
| Ex. A19 | 3 | ◎ | 0.85 | ○ | A | ○ |
| Ex. A20 | 4 | ◎ | 0.73 | ○ | A | ○ |
| Ex. A21 | 5 | Δ | 1.05 | ○ | B | Δ |
| Ex. A22 | 6 | Δ | 0.89 | ○ | B | Δ |
| Comp. Ex. | — | Δ | 0.87 | Δ | C | X |

EXAMPLES A23 to A40

The production of thermal transfer image receiving sheets, the formation of images and the evaluation of the images were effected in the same manner as that of Example A1, except that the following coating solution was used instead of the coating solution used in Example A1. The results are given in the following Table A5. For reference, the results of evaluation for Example A2 and Comparative Example are also given in the following Table A5.

| Composition of Coating Solution: | |
|---|---|
| Dispersion (solid content: 30%) of polyester resin 2 listed in Table A1 | 100 parts |
| Water-dispersible silicone (X-52-550B (solid content: 40%) manufactured by The Shin-Etsu Chemical Co., Ltd.) | 3 parts |
| Colloidal silica listed in the following Table A4 (solid content: 10 to 40%; manufactured by Nissan Chemical Industries Ltd.) | 5 parts |

TABLE A4

| Ex. No. | Colloidal silica | Particle diameter (nm) |
|---|---|---|
| Ex. A23 | Snowtex-S (solid content: 30%) | 7–9 |
| Ex. A24 | Snowtex-C (solid content: 20%) | 10–20 |
| Ex. A25 | Snowtex-N (solid content: 20%) | 10–20 |
| Ex. A26 | Snowtex-O (solid content: 30%) | 10–20 |
| Ex. A27 | Snowtex-OS (solid content: 20%) | 7–9 |
| Ex. A28 | Snowtex-XS (solid content: 20%) | 4–6 |
| Ex. A29 | Snowtex-OCXS (solid content: 10%) | 4–5 |
| Ex. A30 | Snowtex-40 (solid content: 40%) | 10–20 |
| Ex. A31 | Snowtex-50 (solid content: 48%) | 20–30 |
| Ex. A32 | Snowtex-20L (solid content: 20%) | 40–50 |
| Ex. A33 | Snowtex-OL (solid content: 20%) | 40–50 |
| Ex. A34 | Snowtex-XL (solid content: 40%) | 40–60 |
| Ex. A35 | Snowtex-YL (solid content: 40%) | 50–80 |
| Ex. A36 | Snowtex-ZL (solid content: 40%) | 70–100 |
| Ex. A37 | Snowtex-UP (solid content: 20%) | 5–20<br>40–300 |
| Ex. A38 | Snowtex-OUP (solid content: 15%) | 5–20<br>40–300 |
| Ex. A39 | IPA-Snowtex (solid content: 30%) | 10–20 |
| Ex. A40 | NPC-Snowtex (solid content: 20%) | 10–20 |

TABLE A5

| | Overall evaluation | Relative sensitivity | Light fastness | Finger print resistance | Plasticizer resistance | Releasability |
|---|---|---|---|---|---|---|
| Ex. A8 | ○ | 0.88 | Δ | A | ○ | Δ |
| Comp. Ex. | Δ | 0.87 | Δ | C | X | Δ |
| Ex. A23 | ◎ | 0.70 | Δ | B | ○ | ○ |
| Ex. A24 | ○ | 0.73 | Δ | B | ○ | Δ |
| Ex. A25 | ◎ | 0.71 | Δ | B | ○ | ○ |
| Ex. A26 | ◎ | 0.72 | Δ | B | ○ | ○ |
| Ex. A27 | ◎ | 0.72 | Δ | B | ○ | ○ |
| Ex. A28 | ◎ | 0.72 | Δ | B | ○ | ○ |
| Ex. A29 | ◎ | 0.73 | Δ | B | ○ | ○ |
| Ex. A30 | ◎ | 0.70 | Δ | B | ○ | ○ |
| Ex. A31 | ◎ | 0.72 | Δ | B | ○ | ○ |
| Ex. A32 | ○ | 0.75 | Δ | B | ○ | Δ |
| Ex. A33 | ○ | 0.73 | Δ | B | ○ | Δ |
| Ex. A34 | ○ | 0.74 | Δ | B | ○ | Δ |
| Ex. A35 | ○ | 0.73 | Δ | B | ○ | Δ |
| Ex. A36 | ○ | 0.74 | Δ | B | ○ | Δ |
| Ex. A37 | ◎ | 0.70 | Δ | B | ○ | ○ |
| Ex. A38 | ◎ | 0.72 | Δ | B | ○ | ○ |
| Ex. A39 | ◎ | 0.72 | Δ | B | ○ | ○ |
| Ex. A40 | ◎ | 0.72 | Δ | B | ○ | ○ |

EXAMPLES A41 to A45

The production of thermal transfer image receiving sheets, the formation of images and the evaluation of the images were effected in the same manner as that of Example A1, except that the following coating solution was used instead of the coating solution used in Example A1. The results are given in the following Table A7. The results of evaluation for Comparative Example are also given in the following Table A7.

| Composition of Coating Solution: | |
|---|---|
| Dispersion (solid content: 30%) of polyester resin 2 listed in Table A1 | 100 parts |
| Water-dispersible silicone listed in the following Table A6 (manufactured by The Shin-Etsu Chemical Co., Ltd.) | 3 parts |
| Colloidal silica (Snowtex XS (solid content: 20%) manufactured by Nissan Chemical Industries Ltd.) | 5 parts |

TABLE A6

| | Water-soluble silicone |
|---|---|
| Ex. A41 | KF-351 |
| Ex. A42 | KF-352 |
| Ex. A43 | KF-353 |
| Ex. A44 | KF-354 |
| Ex. A45 | KF-355 |

TABLE A7

| | Overall evaluation | Relative sensitivity | Light fastness | Finger-print resistance | Plasticizer resistance | Releasability |
|---|---|---|---|---|---|---|
| Ex. A41 | ◎ | 0.70 | Δ | B | ○ | ○ |
| Ex. A42 | ◎ | 0.74 | Δ | B | ○ | ○ |
| Ex. A43 | ○ | 0.72 | Δ | B | ○ | Δ |
| Ex. A44 | ◎ | 0.69 | Δ | B | ○ | ○ |

TABLE A7-continued

| | Overall evaluation | Relative sensitivity | Light fastness | Finger-print resistance | Plasticizer resistance | Releasability |
|---|---|---|---|---|---|---|
| Ex. A45 | ◎ | 0.69 | Δ | B | ○ | ○ |
| Comp. Ex. | — | 0.87 | Δ | C | Δ | Δ |

As described above, according to the present invention, the formation of the dye-receiving layer by using a dispersion of a dye-receiving resin in an aqueous medium contributes to an improvement in durability, such as fingerprint resistance and plasticizer.

Further, according to one preferred embodiment of the present invention, the formation of the dye-receiving layer by using the above-described aqueous resin dispersion and a water-dispersive or water-soluble silicone oil and/or a colloid solution (colloidal silica) of ultrafine particles of silicic anhydride contributes to an improvement in the releasability of the thermal transfer sheet at the time of the formation of an image.

According to another preferred embodiment of the present invention, the use of a polyester resin insoluble in a general-purpose solvent and the introduction of a minor amount of, for example, a sulfonic group or a group of a salt of sulfonic acid to the polyester resin to impart a hydrophilicity to such an extent that the polyester resin can be easily dispersed in an aqueous medium can provide a thermal transfer image receiving sheet capable of forming an image having satisfactory density and sharpness and excellent in the durability of the formed image, such as fingerprint resistance and plasticizer resistance, etc., without use of any general-purpose solvent.

REFERENCE EXAMPLE B1

An autoclave equipped with a thermometer and an agitator was charged with 48 moles of dimethyl terephthalic acid, 4 moles of dimethyl sodiumsulfoisophthalate, 48 moles of dimethylisophthalic acid, 20 moles of TCD-M and 80 moles of ethylene glycol and 0.5 mole of tetrabutyl titanate. The reaction system was heated at 150° to 220° C. for 3 hr to effect transesterification and then heated to 250° C. over a period of 30 min, and the pressure of the system was gradually reduced so that it became 0.3 mmHg or less 45 min after the initiation of the reduction in the pressure. The reaction was continued for additional 90 min under this condition to provide a transparent polyester resin 1 of pale yellow (molecular weight: 18,000).

The same procedure was repeated to provide polyester resins listed in the following Table B1. Further, these polyester resins were dissolved in butyl cellosolve, the resultant solutions were added by portions to water to provide dispersions of polyester resins, and the solid content of the dispersions was regulated to 30%.

TABLE B1

| No. | Components | Number of moles |
|---|---|---|
| 1 | TCD-M | 20 |
| | ethylene glycol | 80 |
| | terephthalic acid | 48 |
| | isophthalic acid | 48 |
| | 5-sodium sulfoisophthalate | 4 |

TABLE B1-continued

| No. | Components | Number of moles |
|---|---|---|
| 2 | diethylene glycol | 20 |
| | ethylene glycol | 80 |
| | terephthalic acid | 48 |
| | isophthalic acid | 48 |
| | 5-sodium sulfoisophthalate | 4 |
| 3 | cyclohexanedimethanol | 10 |
| | ethylene glycol | 90 |
| | terephthalic acid | 48 |
| | isophthalic acid | 48 |
| | 5-sodium sulfoisophthalate | 4 |
| 4 | TCD-M | 20 |
| | ethylene glycol | 80 |
| | terephthalic acid | 90 |
| | isophthalic acid | 10 |
| 5 | diethylene glycol | 50 |
| | ethylene glycol | 50 |
| | terephthalic acid | 48 |
| | isophthalic acid | 48 |
| | 5-sodium sulfoisophthalate | 4 |
| 6 | TCD-M | 50 |
| | ethylene glycol | 50 |
| | terephthalic acid | 90 |
| | isophthalic acid | 10 |
| Comp. Ex. | neopentyl glycol | 50 |
| | ethylene glycol | 50 |
| | terephthalic acid | 47 |
| | isophthalic acid | 42 |
| | sebacic acid | 11 |

In the following Examples, various properties of the thermal transfer image receiving sheet were evaluated based on the following criteria.

Production of Thermal Transfer Sheets Used in Evaluation

An ink composition for forming a dye-supporting layer was prepared according to the following formulation, coated by means of a wire bar on a 6 μm-thick polyethylene terephthalate film having a reverse face subjected to a treatment for rendering the face heat-resistant so that the coverage on a dry basis was 1.0 g/m$^2$, and the resultant coating was dried to provide a thermal transfer sheet.

| Ink composition | |
|---|---|
| Dye represented by the following structural formula | 1.0 part |
| Polyvinyl butyral resin | 10.0 parts |
| Methyl ethyl ketone/toluene (weight ratio: 1/1) | 90.0 parts |

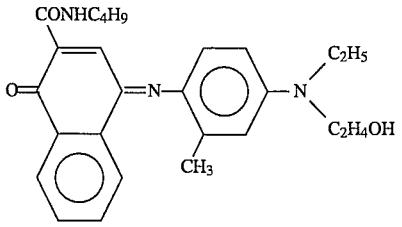

Evaluation Methods

The above-described thermal transfer sheet and thermal transfer image receiving sheets prepared in the following Examples and Comparative Examples were put on top of the other in such a manner that the dye layer and the dye receiving surface faced each other. Recording was conducted by means of a thermal head from the back surface of the thermal transfer sheet under conditions of a head applied voltage of 12.0 V, a pulse width of 16 msec and a dot density of 6 dots/line. Various properties were evaluated by the following methods.

(1) Printing Sensitivity (O.D.):

The reflection density of each image was measured with Macbeth densitometer RD-914, and the printing sensitivity was expressed in terms of the relative value by supposing the reflection density of the image formed in Comparative Example B1 to be 1.00.

(2) Light Fastness Test:

The print was subjected to irradiation by means of a xenon fadeometer (Ci-35A manufactured by Atlas) at 100 KJ/m$^2$ (420 nm), the change in the optical density between before irradiation and after irradiation was measured by means of an optical densitometer (RD-918 manufactured by Mcbeth), and the retention of the optical density was determined according to the following equation.

$$\text{Retention (\%)}=\{[\text{optical density after irradiation}]/[\text{optical density before irradiation}]\}\times 100$$

○: Retention was 85% or more.

Δ: Retention was 80 to 85% exclusive.

x: Retention was less than 80%.

(3) Evaluation of Fingerprint Resistance:

A finger was pressed against the surface of print to leave a fingerprint, and the print was allowed to stand at room temperature for 5 days. Then, the discoloration and change in the density of the fingerprinted portion was evaluated with the naked eye.

A: Substantially no difference was observed between the fingerprinted portion and the non-fingerprinted portion.

B: A discoloration or a change in the density was observed.

C: Dropout occurred in the fingerprinted portion to such an extent that the shape of the fingerprint was clearly observed.

D: Dropout centered on the fingerprinted portion occurred and, at the same time, agglomeration of the dye was observed.

(4) Evaluation of Plasticizer Resistance:

An identical portion of the surface of the print was lightly rubbed with a commercially available eraser five times, and the change in the density was evaluated with the naked eye.

○: Substantially no change in the density was observed.

Δ: Change in the density was observed.

x: The density was greatly changed, and dropout occurred from the low density portion to the medium density portion.

A thermal transfer image receiving sheet of Comparative Example was produced as follows. Synthetic paper (thickness: 110 μm; a product of Oji-Yuka Synthetic Paper Co., Ltd.) was used as the substrate sheet, and a coating solution having the following composition was coated and dried by means of a wire bar on one surface of the synthetic paper so that the coverage on a dry basis was 5.0 g/m$^2$, and the resultant coating was dried to a comparative thermal transfer image receiving sheet which was then evaluated based on the above-described criteria. The results are also given in the following Table B2.

| Composition of Coating Solution: | |
|---|---|
| Polyester resin of Comparative Example listed in Table B1 | 10.0 parts |
| Catalytic curing silicone oil (X-62-1212 manufactured by The Shin-Etsu Chemical Co., Ltd.) | 1.0 part |
| Platinum catalyst (PL-50T manufactured by The Shin-Etsu Chemical Co., Ltd.) | 0.1 part |
| Methyl ethyl ketone/toluene (weight ratio = 1:1) | 89.0 parts |

EXAMPLES B1 to B6

Synthetic paper (thickness: 110 μm; a product of Oji-Yuka Synthetic Paper Co., Ltd.) was used as the substrate sheet, and a dispersion having the following composition was coated and dried by means of a wire bar on one surface of the synthetic paper so that the coverage on a dry basis was 5.0 g/m$^2$, and the resultant coating was dried to provide thermal transfer image receiving sheets of Examples B1 to B6 which were then evaluated based on the above-described criteria. The results are given in the following Table B3. The results of evaluation of the thermal transfer image receiving sheet of Comparative Example are also given in the following Table B3.

| Composition of Coating Solution: | |
|---|---|
| Dispersion (solid content: 30%) of mixture polyester resin 2 listed in Table B1 with resin listed in the following Table B2 (weight ratio = 7:3) | 100 parts |
| Water-dispersible silicone (X-52-550B (solid content: 40%) manufactured by The Shin-Etsu Chemical Co., Ltd.) | 7.5 parts |

TABLE B2

| | Resin |
|---|---|
| Ex. B1 | polyvinyl acetate (NS-2146) |
| Ex. B2 | vinyl acetate/acryl copolymer (PS-120) |
| Ex. B3 | self-crosslinking polyacrylic acid (F-443) |
| Ex. B4 | styrene/acryl copolymer (AP-2268) |
| Ex. B5 | ethylene/vinyl acetate copolymer (EVA-P-3E) |
| Ex. B6 | acrylic microgel (Microgel E-5003, product of Nippon Paint Co., Ltd.) |

In Table B2, resins used in Examples B1 to B6 are Polysol (trade name) series manufactured by Showa High Polymer Co., Ltd.

TABLE B3

| | Overall evaluation | Relative sensitivity | Light fastness | Fingerprint resistance | Plasticizer resistance |
|---|---|---|---|---|---|
| Ex. B1 | ⊙ | 0.85 | ○ | Δ | ○ |
| Ex. B2 | ⊙ | 1.10 | ○ | Δ | ○ |
| Ex. B3 | ⊙ | 1.20 | ○ | Δ | ○ |
| Ex. B4 | ⊙ | 1.15 | ○ | Δ | ○ |
| Ex. B5 | ○ | 1.01 | ○ | Δ | ○ |
| Ex. B6 | ⊙ | 1.08 | ○ | Δ | ○ |
| Comp. | Δ | 0.87 | Δ | C | X |

TABLE B3-continued

| | Overall evaluation | Relative sensitivity | Light fastness | Fingerprint resistance | Plasticizer resistance |
|---|---|---|---|---|---|
| Ex. B1 | | | | | |

EXAMPLES B7 to B11

The production of thermal transfer image receiving sheets, the formation of images and the evaluation of the images were effected in the same manner as that of Example B1, except that the following coating solution was used instead of the coating solution used in Example B1. The results are given in the following Table B5.

| Composition of Coating Solution: | |
|---|---|
| Resin dispersion (solid content: 30%) listed in Table B4 | 100 parts |
| Water-dispersible silicone (X-52-550B (solid content: 40%) manufactured by The Shin-Etsu Chemical Co., Ltd.) | 7.5 parts |

TABLE B4

| Ex. No. | Components | Amount of use (parts) |
|---|---|---|
| Ex. B7 | polyester resin 2 listed in Table B1 | 27 |
| | polycarbonate resin 1 having the following structure | 3 |
| | tert-butyl cellosolve | 11 |
| | water | 59 |
| Ex. B8 | polyester resin 2 listed in Table B1 | 27 |
| | polycarbonate resin 2 having the following structure | 3 |
| | n-butyl cellosolve | 11 |
| | water | 59 |
| Ex. B9 | polyester resin 2 listed in Table B1 | 27 |
| | polyester resin 7 having the following structure | 3 |
| | tert-butyl cellosolve | 11 |
| | water | 59 |
| Ex. B10 | polyester resin 2 listed in Table B1 | 26 |
| | polyester resin 8 having the following structure | 4 |
| | tert-butyl cellosolve | 11 |
| | water | 59 |
| Ex. B11 | polyester resin 2 listed in Table B1 | 27 |
| | polyvinyl chloride resin (SL-40, product of Denki Kagaku Kogyo K.K.) | 3 |
| | n-butyl cellosolve | 11 |
| | water | 59 |

| Composition of Polyester resin 7: | |
|---|---|
| Cyclohexanedimethanol | 35 mol |
| Ethylene glycol | 65 mol |
| Terephthalic acid | 100 mol |

| Composition of polyester resin 8: | |
|---|---|
| TCD-M | 50 mol |
| Ethylene glycol | 50 mol |

-continued

| Composition of polyester resin 8: | |
|---|---|
| Terephthalic acid | 50 mol |
| Isophthalic acid | 50 mol |

| Composition of Polycarbonate Resin 1: |
|---|
| Unit A having the following structure/ unit B having the following structure = 5:5 (weight ratio) |

Composition of Polycarbonate Resin 2:

Unit A having the following structure/unit B having the following structure = 3:7 (weight ratio)

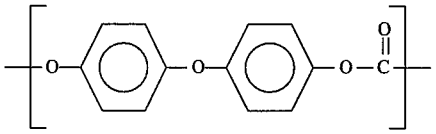

Structural unit A

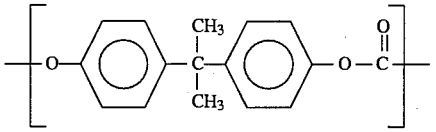

Structural unit B

TABLE B5

| | Overall evaluation | Relative sensitivity | Light fastness | Fingerprint resistance | Plasticizer resistance |
|---|---|---|---|---|---|
| Ex. B7 | ◎ | 0.90 | ○ | A | ○ |
| Ex. B8 | ◎ | 0.90 | ○ | A | ○ |
| Ex. B9 | ◎ | 0.94 | ○ | A | ○ |
| Ex. B10 | ◎ | 0.92 | ○ | B | ○ |
| Ex. B11 | ○ | 0.92 | ○ | A | ○ |
| Comp. Ex. | Δ | 0.87 | Δ | C | X |

As described above, according to the present invention, the formation of the dye-receiving layer by using a dispersion of a mixture of dye-receiving resins dispersed in an aqueous medium contributes to an improvement in durability, such as fingerprint resistance and plasticizer resistance.

Further, according to one preferred embodiment of the present invention, the use of a polyester resin as the dye-receiving resin, the introduction of a minor amount of, for example, a sulfonic group or a group of a salt of sulfonic acid to the polyester resin to impart a hydrophilicity to such an extent that the polyester resin can be easily dispersed in an aqueous medium can provide a thermal transfer image receiving sheet capable of forming an image having satisfactory density and sharpness and excellent in the durability of the formed image, such as fingerprint resistance and plasticizer resistance, etc., without use of any general-purpose solvent.

We claim:

1. A thermal transfer image receiving sheet comprising:

a substrate sheet; and a dye-receiving layer formed on at least one surface of said substrate sheet, wherein said dye-receiving layer is formed by drying a coated dispersion comprising an aqueous dispersion comprising an aqueous medium and a dye-receiving resin dispersed in the aqueous medium, said dye-receiving resin comprising a polyester resin having a hydrophilic group containing a polycarboxylic acid moiety having a minor amount of a sulfonic group or a group of a salt of sulfonic group, whereby said dye-receiving resin is insoluble or sparingly soluble in methyl ethyl ketone, toluene, ethyl acetate, chloroform or ethanol.

2. A thermal transfer image receiving sheet according to claim 1, wherein ethylene glycol occupies 75 to 100% by mole of the polyol moiety of the polyester resin.

3. A thermal transfer image receiving sheet according to claim 1, wherein said polyester resin has a molecular weight in the range of from 5,000 to 40,000 and a softening point in the range of from 40° to 200° C.

4. A thermal transfer image receiving sheet according to claim 1, wherein said dispersion further comprises at least one of a water-dispersible or water-soluble silicone oil and a water-dispersible or water-soluble ultraviolet absorber.

5. A thermal transfer image receiving sheet according to claim 1, wherein said dispersion further comprises a colloid solution of ultrafine particles of silicic anhydride.

6. A thermal transfer image receiving sheet according to claim 1, further comprising a release layer, comprising a reactive silicone, formed on the surface of the dye-receiving layer.

7. A thermal transfer image receiving sheet according to claim 1, wherein said dispersion further comprises at least one of a water-dispersible or water-soluble silicone oil and/or a water-dispersible or water-soluble photostabilizer.

8. A thermal transfer image receiving sheet according to claim 1, wherein said aqueous dispersion comprises a mixture of (A) said polyester resin having a solubility at 25° C. in methyl ethyl ketone, toluene, ethyl acetate or ethanol of 5% by weight or less and (B) an aqueous dispersion of a dye-receiving resin having a glass transition temperature of −10° C. or above.

9. A thermal transfer image receiving sheet according to claim 8, wherein said dye-receiving resin (B) is at least one member selected from the group consisting of polyester, polyvinyl chloride, polyvinyl acetate, styrene/acryl copolymer, vinyl chloride/vinyl acetate copolymer and acrylic microgel.

10. A thermal transfer image receiving sheet according to claim 8, wherein said mixed dispersion further comprises at least one of a water-dispersible or water-soluble silicone oil and a water-dispersible or water-soluble photostabilizer.

11. A thermal transfer image receiving sheet according to claim 8, further comprising a release layer comprising a reactive silicone, formed on the surface of the dye-receiving layer.

12. A thermal transfer image receiving sheet according to claim 1, wherein said dye-receiving resin further comprises a polymer having a highly symmetric aromatic group.

13. A thermal transfer image receiving sheet according to claim 1, whererin the dye-receiving layer comprises a release agent.

14. A thermal transfer image receiving sheet according to claim 1, wherein said dispersion further comprises colloidal silica.

15. A thermal transfer image receiving sheet according to claim 1, wherein said mixed dispersion further comprises at least one of a water-dispersible or water-soluble silicone oil and a water-dispersible or water-soluble photostabilizer.

16. A thermal transfer image receiving sheet according to claim 1, wherein said dye-receiving resin has a solubility at 25° C. in methyl ethyl ketone, toluene, ethyl acetate, chloroform or ethanol of 5% by weight or less.

17. A thermal transfer image receiving sheet comprising:

a substrate sheet; and a dye-receiving layer formed on at least one surface of said substrate sheet, wherein said dye-receiving layer is formed by drying a coated dispersion comprising (a) a mixture of a first aqueous dispersion comprising an aqueous medium and polyester resin dispersed in the aqueous medium and a second aqueous dispersion comprising an aqueous medium and a thermoplastic resin other than said polyester resin, said polyester resin having a hydrophilic group containing a polycarboxylic acid moiety having a minor amount of a sulfonic group or a group of a salt of sulfonic group, whereby said polyester resin is insoluble or sparingly soluble in methyl ethyl ketone, toluene, ethyl acetate, chloroform or ethanol, or (b) a third aqueous dispersion comprising an aqueous medium and both said resins defined in (a).

18. A thermal transfer image receiving sheet according to claim 17, wherein said polyester resin has a solubility at 25° C. in methyl ethyl ketone, toluene, ethyl acetate, chloroform or ethanol of 5% by weight or less and the resin other than said polyester resin has a glass transition temperature of −10° C. or above.

19. A thermal transfer image receiving sheet according to claim 17, wherein ethylene glycol occupies 75% by mole or more of the polyol moiety of the polyester resin.

20. A thermal transfer image receiving sheet according to claim 17, wherein said polyester resin has a molecular weight in the range of from 5,000 to 40,000 and a softening point in the range of from 40° to 200° C.

21. A thermal transfer image receiving sheet according to claim 20, wherein the polycarbonate resin has a molecular weight in the range of from 5,000 to 50,000.

22. A thermal transfer image receiving sheet according to claim 17, wherein the resin other than the polyester resin is at least one member selected from the group consisting of polycarbonate resin, solvent-soluble polyester resin, polystyrene resin, polyurethane resin, polyvinyl chloride resin, polyvinyl acetate resin, styrene/acryl copolymer and vinyl chloride/vinyl acetate copolymer.

23. A thermal transfer image receiving sheet according to claim 22, wherein said polycarbonate is a random copolycarbonate resin comprising structural units represented by the following general formulae (1) and (2), the molar ratio of the structural unit represented by the general formula (1) to the structural unit represented by the general formula (2) being 30:70 to 70:30

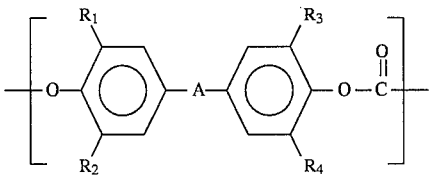

(1)

-continued

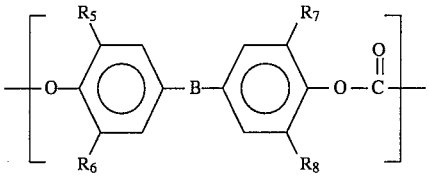

(2)

wherein $R_1$ to $R_8$ stand for hydrogen, a halogen or an alkyl group having 1 to 4 carbon atoms, A stands for a straight-chain, branched or cyclic alkylidene group having 1 to 10 carbon atoms, an aryl-substituted alkylidene group, an aryl group or a sulfonyl group and B stands for an oxygen atom or a sulfur atom.

24. A thermal transfer image receiving sheet according to claim 17, wherein said dispersion comprises (A) said polyester resin comprising a polycarboxylic acid moiety having a minor amount of a sulfonic group or a group of a salt of sulfonic group, (B) a resin other than said polyester resin, (C) a water-soluble organic solvent having a boiling point of 60° to 200° C. and (D) water, and said components A to D satisfy requirements represented by the following respective equations 1 to 3:

$A+B+C+D=100$ (weight ratio), equation 1

$A:B:C:D=10$ to 70:2 to 40:1 to 10:20 to 87 (weight ratio), equation 2

$.02 \leqq C/(C+D) \leqq .66$ (weight ratio). equation 3

25. A thermal transfer image receiving sheet according to claim 17, wherein said dispersion is produced by dissolving and dispersing said components (A) and (B) in said component (C) and adding said component (D) to said dispersion, or by dispersing a mixture of said component (A) with said component (B) in a mixture of said component (C) with said component (D).

26. A thermal transfer image receiving sheet according to claim 17, wherein said dispersion further comprises at least one of a water-dispersible or water-soluble silicone oil and a water-dispersible or water-soluble ultraviolet absorber.

27. A thermal transfer image receiving sheet according to claim 17, further comprising a release layer comprising a reactive silicone, formed on the surface of the dye-receiving layer.

* * * * *